United States Patent [19]

Calzolari

[11] 3,994,627

[45] Nov. 30, 1976

[54] PUMPING APPARATUS FOR WET CONCRETE

[75] Inventor: Sergio Calzolari, Rome, Italy

[73] Assignee: Fogt Industriemaschinenvertretung A.G., Chur, Switzerland

[22] Filed: Nov. 12, 1974

[21] Appl. No.: 523,017

[30] Foreign Application Priority Data

Nov. 16, 1973 Italy ..... 53733/73
Oct. 17, 1974 Italy ..... 53596/74

[52] U.S. Cl. ..... 417/317; 417/342; 417/344

[51] Int. Cl.[2] ..... F04B 9/10

[58] Field of Search ..... 417/317, 342, 344, 347, 417/339

[56] References Cited

UNITED STATES PATENTS

| | | | |
|---|---|---|---|
| 1,543,201 | 6/1925 | Bell | 417/342 |
| 2,579,568 | 12/1951 | Habenicht | 417/317 X |
| 2,942,553 | 6/1960 | Moeller | 417/344 X |
| 3,279,382 | 10/1966 | Bennett | 417/317 X |
| 3,326,135 | 6/1967 | Smith | 417/342 X |
| 3,327,634 | 6/1967 | Whiteman | 417/317 |
| 3,327,641 | 6/1967 | Klosterman | 417/317 X |

*Primary Examiner*—Alan Cohan
*Attorney, Agent, or Firm*—Wigman & Cohen

[57] ABSTRACT

A pumping apparatus for wet concrete and the like comprising a pair of piston pumps having parallel axes, interlocked to one another and operating in phase opposition, the orifices of which are alternatively put in communication one with the conduit feeding the wet concrete and the other with the delivery conduit and vice versa by means of a reciprocally movable baffle blade valve having two operative limit positions, characterized by the fact that the pump pistons are each actuated by a single-acting jack, being provided means to at first move the baffle valve into either of its operative positions by means of a hydraulic control device, and then to actuate the jack which is about to begin its intake stroke only when the baffle blade valve has reached one of the limit positions, and to reverse the position of said baffle valve into its second limit position before the beginning of the compression stroke of the pump actuated by said jack and vice versa, and means for interlocking the movements of the jacks, and thus of the pumps connected therewith.

6 Claims, 15 Drawing Figures

PUMPING APPARATUS FOR WET CONCRETE

The present invention relates to a pumping apparatus for wet concrete or other similar materials and more particularly it relates to the pumping apparatus control system, said pumping apparatus comprising two single-acting pumps operating in phase opposition and actuated by single-acting hydraulic jacks which have parallel axes and interlocked movements, each of said pumps having an orifice arranged near one of its ends and which is alternately put in communication with a conduit feeding the wet concrete or with a concrete delivery conduit by means of a baffle valve having two operative limit positions, means to control the reversing of said baffle valve and then to control the movement of one of said jacks only and after said baffle valve has attained the other limit position and for reversing the position of said baffle valve only after the completion of said jack stroke, and means to move the pistons of the jacks in phase opposition and to correct any of their dephasings.

According to a first embodiment the jacks actuating the pumps are interconnected by mechanical means so as to provide a less expensive apparatus which occasionally requires some adjustments.

According to a second and preferred embodiment an hydraulic transmission is provided for interlocking the movements of the two jacks in such a manner that the compression stroke of the second jack is caused by the intake stroke of the first jack and vice versa.

For such a purpose means are provided enabling an automatic control of the volume of the fluid, in particular oil, designed to transmit the pressure from one jack to another in order to compensate for losses or to discharge the fluid in excess so that the jacks, and thus the pumps always operate in an exact phase opposition.

It is known that the pumping of wet concrete presents problems on account of the high wear to which are subjected the members which come into contact with such a type of material, and, in particular in the case of the concrete, because such a material is constituted of a mixture of solid materials, i.e. aggregates and cement, and of water, so that the pumpability of the wet concrete depends strictly upon a correct composition of this latter and to the fact that such a composition is maintained. In the pumps for wet concrete, it is thus of vital importance that along the concrete path no water separation takes place; therefore the devices and the elements of such an apparatus must be simple and must present neither recessed or restricted areas nor angled portions where the material could stop and be separated from the water, thus causing the formation of deposits or incrustations. Further, the structure of the apparatus must be very strong so as to be able to take the stresses in question, in particular the high pressures which are necessary for pushing the wet concrete to the desired site locations. Further, the structure has to be also simple enough and to occupy little space so as to be able to be used in wheeled plants which are designed to transport the concrete ready to be used directly to the desired sites. This invention solves these problems by a simple apparatus which can be of universal application which is of high reliability.

Two embodiments of the invention are hereinafter particularly described by way of example only, with reference to the drawings in which.

Figure 7:
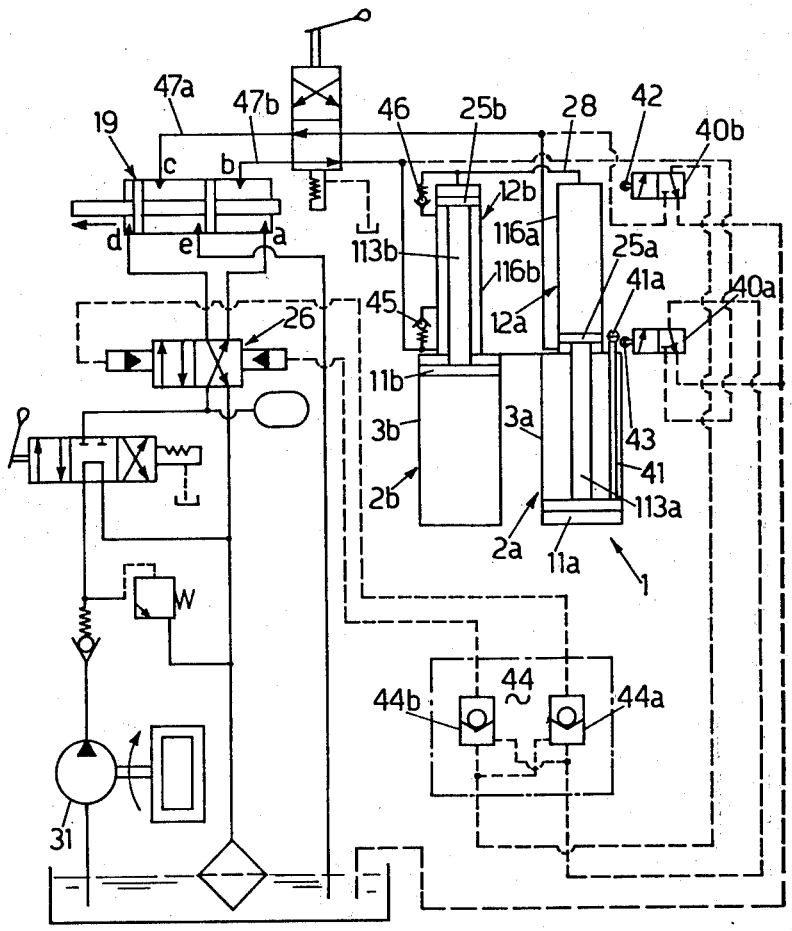

FIG. 7 shown diagrammatically the hydraulic circuit and the pumping unit modified according to the second embodiment and showing the positions of the parts in one of the phases of the operative cycle;

FIGS. 8*a*, 8*b*, 8*c* and 8*d* show diagrammatically the detail of the pair of hydraulic jacks, shown in FIG. 7, in order to illustrate how the discharge of the transmission oil takes places; and FIGS. 9*a*, 9*b*, 9*c* and 9*d* show the same detail to illustrate how oil is automatically supplied to compensate for losses.

First will be described the mechanical structure of the pumping unit shown in the FIGS. 1 to 4.

Said pumping unit, generally marked 1, comprises two piston pumps 2*a* and 2*b* having parallel axes, the cylinders 3*a* and 3*b* of which at one of their ends communicate with a chamber 4 arranged in a valve casing 5 having an entrance conduit 6 and a delivery conduit 7 and which are coaxial to one another.

Figure 1:
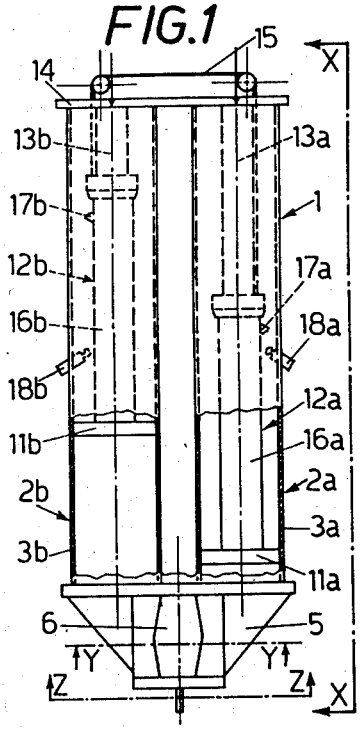
FIG. 1 is a front view partially sectioned of the pumping unit and of the valve casing connected thereto, according to a first embodiment of the invention.
Figure 2:
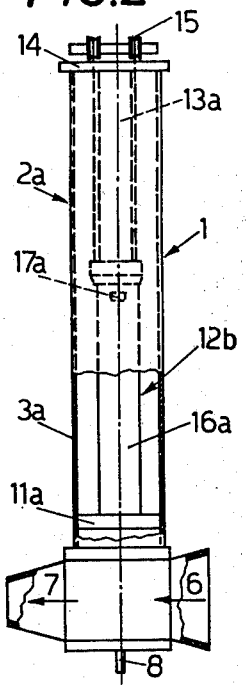
FIG. 2 is a side view partially sectioned of the parts shown in FIG. 1 and taken along the line X—X of FIG. 1.
Figure 4:
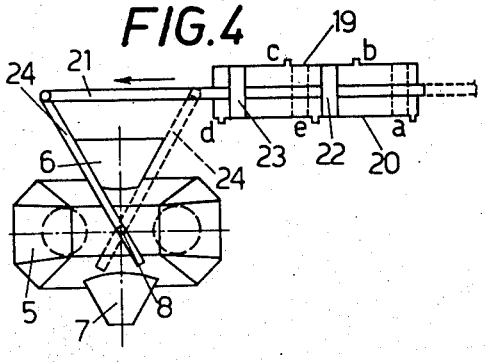
FIG. 4 is the end view of the valve body and of the control arm of the valve spindle taken along line Z—Z of FIG. 1 (said arm having not been shown in FIGS. 1 and 2), and of the unit for the distribution of the fluid actuating the valve and the pumping unit, while in broken lines is shown the disposition of the parts in the second operative position.
Figure 3:
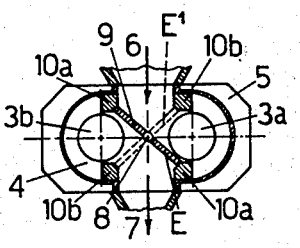
FIG. 3 is a cross section of the valve body taken along line Y—Y of FIG. 1.

In the chamber 4 is mounted a valve swingable about the axis of a spindle 8 and which is constituted of a reciprocating baffle blade 9 having two limiting operative positions and specifically a position E, in which the baffle valve is positioned as shown in solid lines in FIG. 3 and has its peripheral edges pressed against the seal of the members 10*a* and another symetrical limiting position $E^1$ (shown in broken lines in FIG. 3), in which said peripheral edges abut against the edges of the members 10*b*. The accuracy of the shaping of the valve blade 9, of the chamber 4 and of the bodies 10*a*—10*a* and 10*b*—10*b* must be such that in the position E and $E^1$ a fluid-tight closure is obtained between the portions of the chamber 4 upstream and downstream of the said blade 9. The members 10*a* and 10*b* are made of very hard material so as to act together with the baffle blade 9 as co-operating cutting members to crush any solid element of the concrete mixture which could be retained therebetween.

At the position E the baffle blade 9 puts the cylinder 3*a* in communication with the concrete supply conduit 6 and the cylinder 3*b* with the delivery conduit 7, while at the position $E^1$ the opposite takes place.

Into the cylinders 3*a* and 3*b* are slidably mounted the pistons 11*a* and 11*b* respectively actuated by hydraulic self-acting jacks 12*a* and 12*b* in which a pressurized fluid, in particular, oil operates. In this embodiment said jacks 12*a* and 12*b* have their piston rods 13*a* and 13*b* fixed to the stationary framing 14 of the pumping unit, while along said piston rods slide the respective cylinders 16*a* and 16*b* connected to one another by a pair of cables 15 or other suitable means adapted to interlock their movements. The free ends of said cylinders 16*a* and 16*b* carry the pistons 11*a* and 11*b* of the two piston pumps, therefore said cylinders 16*a* and 16*b* of the jacks act as piston rods of the pistons 11*a* and 11*b*.

Near the end of each cylinder 16*a* and 16*b* opposite to that carrying the pistons 11*a* and 11*b* extends outwardly a finger 17*a* and 17*b* respectively for co-operation with limiting switches 18*a* and 18*b* so that as the respective cylinder 16*a* or 16*b* reaches the end of its compression stroke, the changeover of a valve 26 is caused, which is designed to reverse the direction of the liquid flow controlling the five-way actuator-distributor-jack, generally marked 19 (FIG. 5) which controls the movements of the baffle blade 9 and those of the jacks 12*a*, 12*b* and which will be hereinafter more fully described.

During the compression stroke of the pump position 11*a* or 11*b* actuated by that jack 12*a* or 12*b* in which the pumping phase takes place, owing to the cable or cables 15 the return stroke of the other jack cylinder 16*a* or 16*b* takes place and as a result thereof the return stroke of the pump piston 11*a* or 11*b* connected respectively thereto takes place so that each pumping unit performs its suction stroke at expense of the fluid operating into the cylinder of the jack into which the pressurized fluid is fed.

The valve 9 is moved from an operative limit position to the other by means of oil fed by a distribution double-acting jack having two pistons and acting as an actuator-distributor 19, said unit being shown in the FIGS. 4 to 7 and comprising a cylinder 20 through which passes a piston rod 21 carrying two pistons 22 and 23 and having five orifices *a*, *b*, *c*, *d* and *e*. The rod 21 is pivotally connected at one of its ends to the arm 24 (FIG. 4) which is fixedly connected with the spindle 8 of the baffle blade 9 which is parallel to the axes of the piston pumps 2*a* and 2*b* (FIG. 2) so as to cause the movement of the blade 9 from the position E to the position $E^1$ and vice versa. The orifices *a* and *d* are connected through the reversing valve 26 to the main supply circuit of the pressurized oil fed through a main pump 31 which sucks oil from the reservoir 30 through the pipes 27 and 29 in which is arranged a non-return valve 32 and under the control of a safety valve 33 which opens discharging the oil into reservoir 30 through a filter 34 as the pressure in the circuit exceeds a predetermined value in order to obtain a protection against dangerous over pressures.

Figure 5:
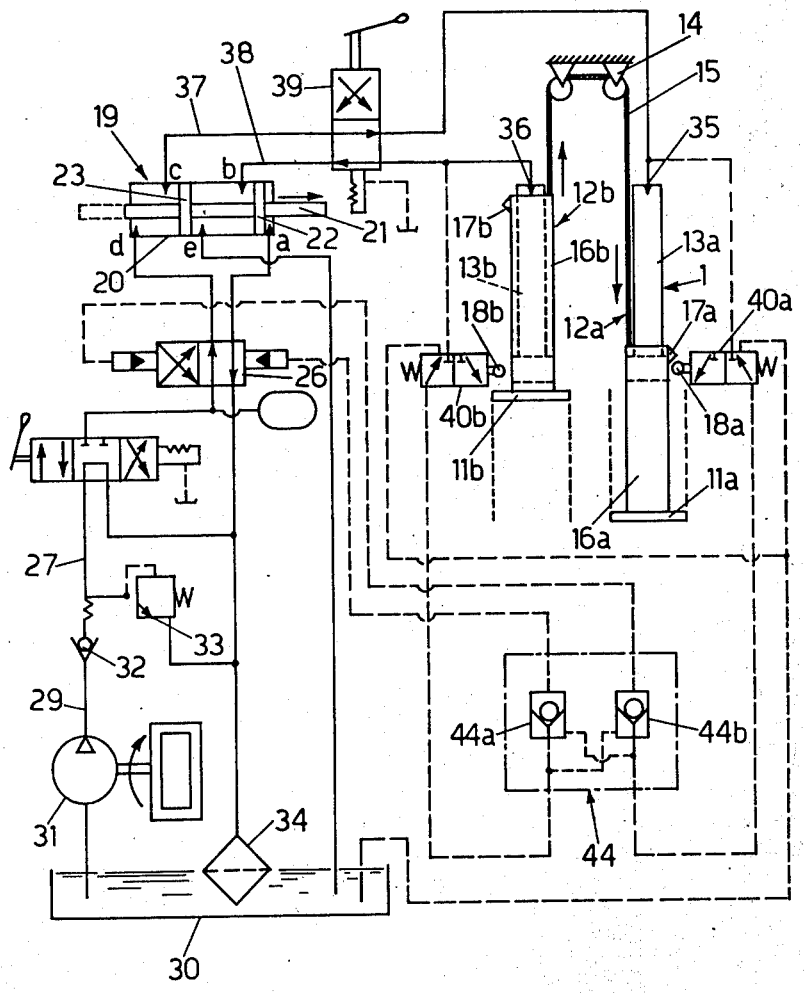
FIGS. 5 and 6 show diagrammatically the hydraulic circuit for the control of the pumping unit in two different phases of the operative cycle of the pumping unit shown in FIGS. 1 to 4.

The actuator-distributor 19 at the end of the compression stroke of the piston pump 2*a* is in the position shown in FIG. 5; therefore the finger 17*a* actuates the switch or push-button 18*a* which causes the reversing of the changeover of the valve 26 by means of the valve 44*b* of the valve set 44 including two ball check valves, said valve 44*b* being actuated under the control of device 40*a*. The valve set 44 may be a conventional pilot operated check valve in which a pressure rise in the inlet unseats both a check valve in the inlet and a check valve in the outlet to permit the return flow through the outlet line. An example of such conventional valve is a Series VCPD LOAD-LOK pilot operated in-line type check valve manufactured by the Mobile Power and Controls Division of Parker-Hannifin and illustrated and described in their Catalog 1710-Rev. October 1971 on pages 41 and 42 thereof.

Figure 6:
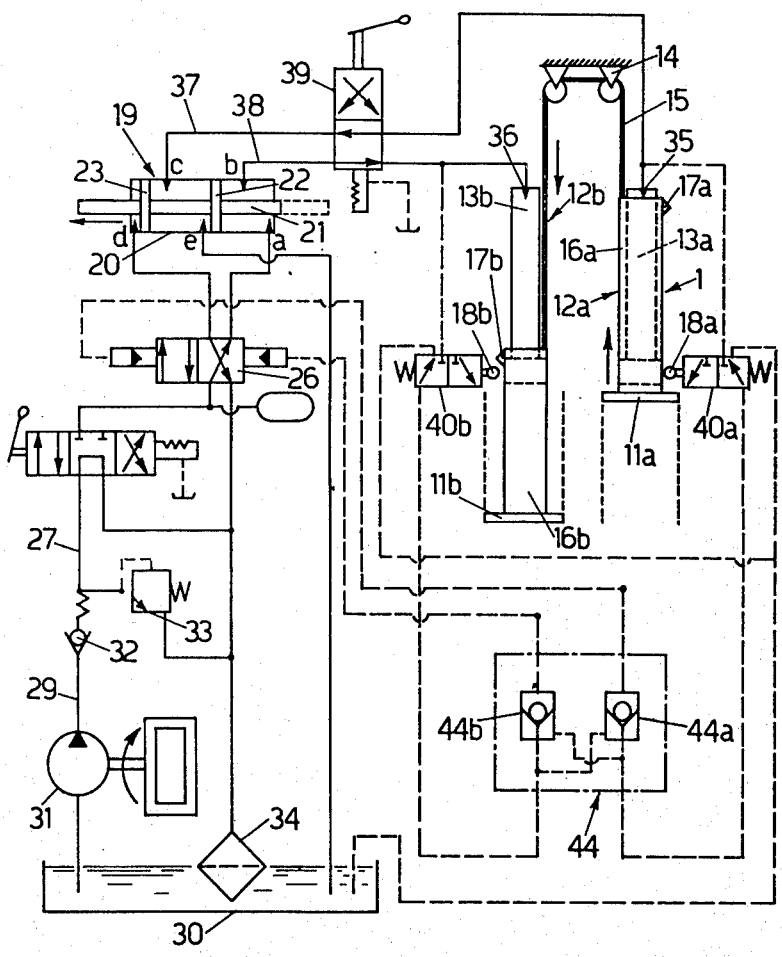

As pressurized oil is fed through the conduit 27 to the orifice *a*, said oil acts on the right face of the piston 22 forcing it to move towards the left pushing forwards in the same direction the piston rod 21 which by means of the arm 24 and the spindle 8 moves the valve blade 9 to the position E. But the pumping unit remains yet inoperative until the piston 22 uncovers the orifice *b* and the piston 23 uncovers the orifice *c;* in such a manner the pumping unit remains locked in the event that owing to an obstruction, the valve blade 9 cannot attain the predetermined limiting position so that the rod 21 cannot further move to uncover with its piston 22 the orifice *b*. This orifice *b* is connected through the pipe 38 to the orifice 36 of the inner chamber of the jack 12*b*, and the orifice *c* is connected through the pipe 37 to the orifice 35 of the jack 12*a* actuating the piston 11*a* which is about to begin its intake stroke. As soon as the piston 22 has overcome the orifice *b* a communication is obtained between the conduit 27 of the pressurized oil and the jack 12*b* through the orifices *a* and *b* which are now in communication one with another, while the contemporaneous advancement of the piston 23 puts the orifice *c* in communication with the central discharge orifice *e* connected to the reservoir 30 so that under the effect of the cable traction the cylinder 16*a* raises upwards and the fluid which has worked during the preceeding stroke into the jack 12*a* is now discharged passing through the actuator-distributor 19 from the orifice *c* to the orifice *e* (FIG. 6).

As the jack cylinder 16*b* has reached the limit position of the compression stroke, the finger 17*b* striking against the switch 18*b*, through the control device 40*b* and the valve 44*a* controls again the changeover of the valve 26 so that pressurized oil will be now fed to the orifice *d* and the rod 21 of the actuator-distributor 19 moves towards the right hand so that after the first section of its stroke during which the baffle blade 9 is actuated, as the piston 23 has uncovered the orifice *c* the oil is fed into the cylinder 16*a* of the jack 12*a*, while the discharge phase takes place into the other jack 12*b*, since the piston 22 has at its turn overcome the orifice *b* (FIG. 5), and so on.

At the end of the work it is necessary to suck the wet concrete which remains in the delivery piping in order to expel it through the orifice 6 in order to avoid formations of incrustations of set concrete. For such a purpose the conduits 37 and 38 are interconnected by a deviation valve 39 enabling the operation of the pumping unit to be dephased of a semi-cycle so that during the intake phase the cylinder 2*b* will be put in communication with the conduit 37 and at the same time the cylinder 2*a* performing its compression stroke ejects the material previously sucked from the pipe 7 through the pipe 6.

In the embodiment of FIGS. 7, 8*a* to 8*d* and 9*a* to 9*d* the pumping unit is substantially identical to that of the first embodiment. But in this variant the single-acting jacks 12*a* and 12*b* have slidable piston rods 113*a* and 113*b*, and fixed cylinders 116*a* and 116*b* which are coaxial and made integral respectively with the cylinders 3*a* and 3*b* of the pumps 2*a* and 2*b* according to a tandem disposition. the rods 113*a* and 113*b* carry the jack pistons 25*a* and 25*b* respectively as well as the pistons 11*a* and 11*b* respectively of the pumps 2*a* and 2*b*. The jack cylinders 116*a* and 116*b* at their upper ends are interconnected by means of a pipe 28 enabling the oil which is placed above one of the pistons 25*a* and 25*b* to pass into the other cylinder and vice versa, said oil acting only as an hydraulic transmission medium between the two jacks 12*a* and 12*b*, since according to this embodiment, it is the pressurized oil only which, upon entering one of the cylinders 116*a* or 116*b*, causes the movement of the respective piston 25*a* or 25*b*, which, in turn, presses on the transmission oil, forcing it to pass into the other cylinder 116*b* or 116*a*, thus causing the movement of the other piston 25*b* or 25*a* and of the rod integral therewith and as a result, causing the compression stroke in the pump connected thereto which forces the wet concrete to travel along the delivery piping.

The two jacks 12*a* and 12*b* are not equal, but they present the following differences.

The piston 11*a* is connected to a second rod 41 parallel to the rod 113*a* and mounted in such a position to extend out of the cylinder 3*a* and remaining always out of the cylinder 116*a* so as to actuate by its 41*a* the switches 42 and 43 at the limit positions of the stroke of the piston 25*a*. The switches 42 and 43 have the same task as the switches 18*a* and 18*b* of the first embodiment, but are controlled by the movement of one jack (in the shown embodiment the jack 12*a*) for the reasons hereinbelow described.

The reciprocation of the piston in the other jack 12*b* does not actuate any limit switch, but to the cylinder 116*b* of said jack 12*b* are connected the two unidirectional check valves 45 and 46 positioned near its heads and having adjustable inner springs and of a type well known. Said connection is performed by means of pairs of pipes opening into the cylinder 116*b* upstream and downstream of the piston 25*b* at its two limit positions. Such a disposition permits the jacks 12*a* and 12*b* to operate always in exact phase opposition and also permits automatic correction of any dephasing due to an excess or deficiency of the transmission oil.

According to this preferred embodiment the two pipes 47*a* and 47*b* of the pressurized oil coming from the five-way actuator-distributor 19 end near the lower heads of the cylinders 116*a* and 116*b*, each alternately acting as feeding pipe for one of the jacks and as a discharge pipe for the pressurized oil forced out of the other and vice versa. On the contrary, the oil which serves as an hydraulic transmission medium between the two jacks 12*a* and 12*b* and which is collected above the pistons 25*a* and 25*b* in the connecting pipe 28 has or should have always a substantially constant volume.

Figure 8A:
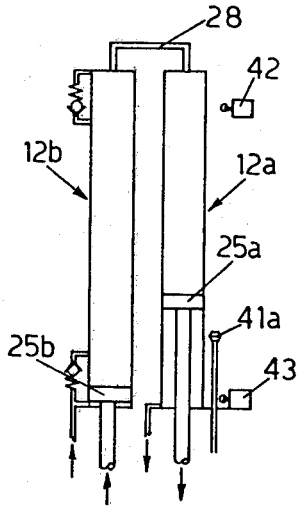
Figure 8B:
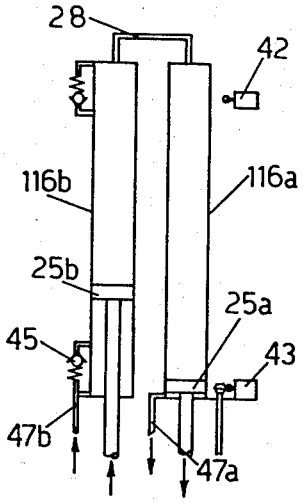
Figure 8C:
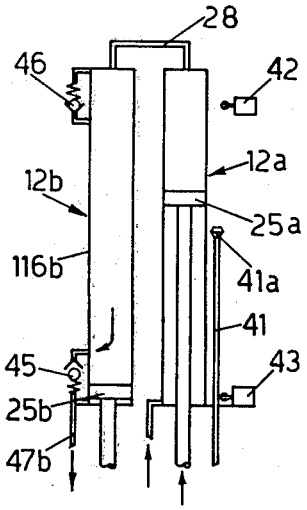

Now will be described with reference to the FIGS. 8*a* to 8*d*, how a portion of the transmission oil is automatically discharged in the event that this oil is in excess. In the arrangement of FIG. 8*a*, the pressurized oil is fed into the cylinder 116*b* through the pipe 47*b* and pushes upwards the piston 25*b* which in turn pushes after itself the transmission oil which passes from the pipe 28 into the cylinder 116*a*, where the oil causes the lowering of the piston 25*a* which discharges through the pipe 47*a*, the oil which is downstream of it, said piston 25*a* now having been positioned at the upper limiting position at the beginning of this stroke since it has been assumed that its volume is higher than the predetermined volume, said volume difference having been increased for clarity. In consequence of the raising of the rod 113*b* in the pump 2*b* the intake stroke of the wet concrete takes place, while into the pump 2*a* starts the compression stroke. In such an operative disposition the adjustable valve 45 closes, since this valve is so arranged that as the pressurized oil is fed through the pipe 47*b*, said valve cannot open.

Figure 8D:
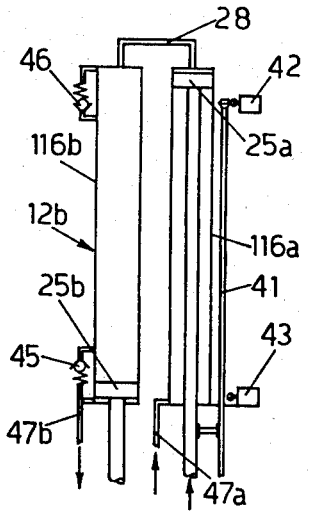

On account of the fact that the volume of transmission oil is in excess, the piston 25*a* reaches its down limit position (FIG. 8*b*) before the piston 25*b* can reach the upper limit position and therefore the head 41*a* actuates the switch 43 causing the changeover of the valve 26. Thus, the pressurized oil (FIG. 8*c*) is now fed through the pipe 47*a* into the cylinder 116*a* where it forces the piston 25*a* to move upwards and that forces the transmission oil to pass into the cylinder 116*b*, in which it presses downward the piston 25*b* which will reach its down limiting position before the piston 25*a* can reach its upper limit position and actuate the switch 42 to changeover again the valve 26. Since the piston 25*b* in such a down limit position must stop, while the piston 25*a* continues its travel, the transmission oil which is placed upstream of said piston 25*b* will be now compressed, since the entrance orifice of the check valve 45 is now uncovered and said valve opens putting the chamber of the cylinder 116*b* upstream of said piston 25*b* in communication with the pipe 47*b* downstream thereof, said valve remaining in its opened position unitl the piston 25*a* has reached it upper limit position, where it actuates the switch 42 so that the pressurized oil can be fed again through the pipe 47*b* (FIG. 8*d*). In such a manner the predetermined volume of the transmission oil is restored and the pistons 25*a* and 25*b* automatically recover their exact disposition in phase opposition.

Figure 9A:
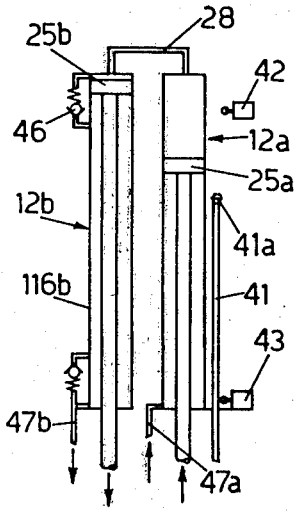
Figure 9B:
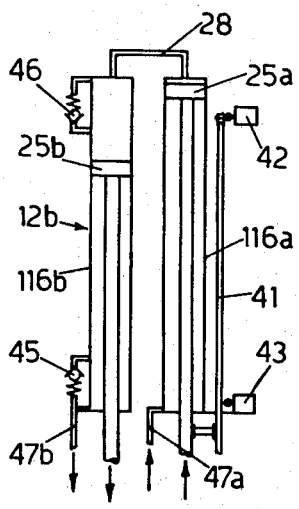
Figure 9C:
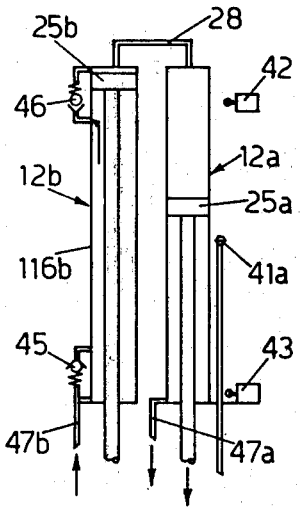
Figure 9D:
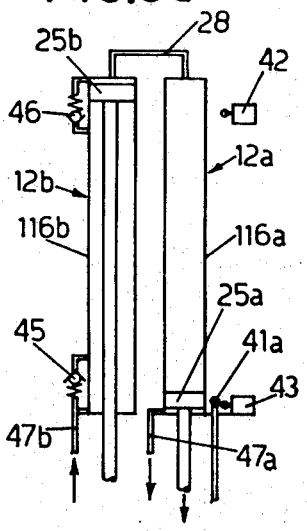

In the case wherein the transmission oil has a volume lesser than the predetermined value and if the pressurized oil is fed into the cylinder 116*a* through the pipe 47*a* (FIG. 9*a*), said oil forces the piston 25*a* to raise, but it cannot let move yet the piston 25*b* which remains in its upper limit position until the piston 25*a* does not begin to press on the transmission oil forcing this latter to pass into the cylinder 116*b* (FIG. 9*b*).

When the piston 25*a* reaches its upper limit position, the piston 25*b* is yet far from its down limit position, but as a result of the actuation of the switch 42 the feed direction of the pressurized oil is reversed and said oil now arrives into the cylinder 116*b* through the pipe 47*b* and causes the movement of the piston 25*b* until this latter reaches its upper limit position, while the piston 25*a* lowers, on the contrary, only of a fraction of its stroke, beyond of which it cannot advance due to the deficiency of the transmission oil.

On account of the fact that the lower switch cannot be actuated, oil continues to enter the cylinder 116*b* so that its pressure will increase. The inlet pipe of the unidirectional check valve 46 through which can pass a flow of pressurized oil capable to cause the opening of this valve is now downstream of the piston 25*b* which stands still at its upper limit position, said valve being adjusted to open in one direction as the oil pressure at its inlet orifice is greater by a predetermined value than the pressure downstream of this valve and according to which the inner spring has been calibrated so that through said valve 46 the oil by-passes the piston 25*b* and can arrive upstream of this latter enetering the pipe 28 and then the cylinder 116*a* until the piston 25*a* has been moved up to its down limit position (FIG. 9*d*), where it actuates the switch 43, thus being automatically restored the volume of the transmission oil and therefore the operation in exact phase opposition of the pistons 25*a* and 25*b*.

I claim:

1. Apparatus for pumping wet concrete and the like comprising a pair of piston pumps mounted in parallel relation and operating in phase opposition, said piston pumps each including a single acting fluid pressure piston and cylinder, said piston pumps each having a reciprocating piston and a cylinder, each piston pump cylinder having an open end, a baffle blade valve means arranged at the open ends of said piston pump cylinders and having two limit positions for controlling the charging and discharging of wet concrete through respective open ends of said piston pump cylinders, a source of pressurized fluid, a five-way fluid actuator-distributor means coupled to said baffle blade valve means and hydraulically connected between said source of pressurized fluid and said fluid pressure cylinders for controlling the position of said baffle blade valve means and for supplying pressurized fluid to and discharging pressurized fluid from said fluid pressure cylinders, said actuator-distributor means having a first operative position for first moving said baffle blade valve means to one of said two limit positions and for subsequently supplying pressurized fluid to a first one of said fluid pressure cylinders and discharging pressurized fluid from a second one of said fluid pressure cylinders and a second operative position for first moving said baffle blade valve means to the other of said two limit positions and subsequently supplying pressurized fluid to said second fluid pressure cylinder and discharging pressurized fluid from said first fluid pressure cylinder, changeover valve means connected to said actuator-distributor means for shifting said actuator-distributor means between the first and second operative positions thereof, means for hydraulically interlocking the movements of the pistons of said fluid pressure cylinders and means restoring pressurized fluid in said hydraulic interlocking means and discharging therefrom excess pressurized fluid for maintaining said piston pumps in substantially exact phase opposition.

2. Apparatus according to claim 1 wherein said source of pressurized fluid includes a fluid reservoir and a main motor pump, means for withdrawing fluid from said reservoir and conveying the fluid into a main hydraulic circuit under the control of a safety valve arranged to open as the fluid pressure overcomes a predetermined value, said actuator-distributor means including a double-acting jack having an orifice arranged adjacent each end thereof and connected through said changeover valve means to said main hydraulic circuit, said jack further having two intermediate orifices and a central orifice, each of said two intermediate orifices being connected via fluid supply conduits with a respective fluid pressure cylinder and said central orifice being connected to said reservoir, a spindle slidable in said jack and operatively coupled to said baffle blade valve means, said spindle having two spaced pistons, said spaced pistons and intermediate orifices being positioned such that said intermediate orifices are alternately overcome by said spaced pistons after a portion of the stroke of said spindle in alternate directions, said portion of the stroke in alternate directions being of sufficient length to actuate the baffle blade valve means into a respective one of said two limit positions.

3. Apparatus according to claim 2 including delivery and supply conduits connected to said baffle blade valve means and wherein the conduits connecting the the intermediate orifices of said jack to the fluid pressure cylinders are interconnected by a reversing valve so as to change the work strokes of the fluid pressure cylinders and thus the work strokes of the piston pumps associated therewith to thereby obtain a suction effect on the wet concrete through the delivery conduit and a discharge of the wet concrete through the supply conduit for cleaning the apparatus at the end of the work cycle.

4. Apparatus according to claim 2, wherein each of said fluid pressure cylinders is fixed and connected in tandem with a respective piston pump, the cylinder of each fluid pressure cylinder being integrally formed with the cylinder of its respective piston pump, the piston of each fluid pressure cylinder and the piston of its respective piston pump being connected to each other by a common piston rod, said fluid supply conduits being connected to a respective fluid pressure cylinder at the end thereof adjacent its associated piston pump cylinder and wherein said hydraulic interlocking means includes a conduit interconnecting the other ends of said fluid pressure cylinders such that the supply of pressurized fluid into one of said fluid pressure cylinders actuates an intake stroke of its respective piston pump and a compression stroke of the other fluid pressure cylinder, thus actuating the power stroke of the piston pump associated with said other fluid pressure cylinder.

5. Apparatus according to claim 1 wherein said means for maintaning said piston pumps in substantially exact phase oppostion comprises two limit switches arranged respectively at locations corresponding to first and second predetermined limiting positions of the piston of said first fluid pressure cylinder, said switches being operatively connected to said changeover valve means for controlling the position of said changeover valve means to shift said actuator-distributor means between its operative positions, the piston of said second fluid pressure cylinder having upper and lower limit positions and first and second check valves, said first check valves connected to said second fluid pressure cylinder across the piston thereof at the upper limit position of such piston and said second check valve connected to said second fluid pressure cylinder across the piston thereof at the lower limit position of such piston, the outlet of each check valve being connected adjacent a respective end of said second fluid pressure cylinder and the inlets of said check valves being connected intermediately of the ends of said second fluid pressure cylinder.

6. apparatus according to claim 5 including an auxiliary rod connected to and cooperating with the piston of the piston pump associated with said first fluid pressure cylinder, said rod being arranged parallel to said first fluid pressure cylinder and extending through the cylinder of the cooperating piston pump, said auxiliary rod being positioned to actuate one of said limit switches when the piston of said first fluid pressure cylinder is reciprocated to either of said first and second predetermined limiting positions.

* * * * *